United States Patent [19]

Beckmann et al.

[11] 4,443,135

[45] Apr. 17, 1984

[54] CONTROL APPARATUS

[75] Inventors: Klaus Beckmann, Lunen; Hans-Theodor Grisebach, Unna; Walter Weirich, Dortmund, all of Fed. Rep. of Germany

[73] Assignee: Gewerkschaft Eisenhutte Westfalia, Fed. Rep. of Germany

[21] Appl. No.: 335,827

[22] Filed: Dec. 30, 1981

[30] Foreign Application Priority Data

Jan. 3, 1981 [DE] Fed. Rep. of Germany ..... 3100093

[51] Int. Cl.[3] ..... E21D 15/46

[52] U.S. Cl. ..... 405/302; 405/291

[58] Field of Search ..... 405/290-302; 251/205, 321, 322; 137/530

[56] References Cited

U.S. PATENT DOCUMENTS

| | | | |
|---|---|---|---|
| 2,752,757 | 7/1956 | Joy | 405/302 X |
| 2,859,022 | 11/1958 | Frye | 405/302 |
| 3,478,522 | 11/1969 | Rieschel | 405/302 X |
| 3,832,856 | 9/1974 | Sigott et al. | 405/302 |
| 4,325,659 | 4/1982 | Plevak et al. | 405/302 X |

FOREIGN PATENT DOCUMENTS

| | | | |
|---|---|---|---|
| 2729564 | 12/1978 | Fed. Rep. of Germany | 405/302 |
| 1245732 | 9/1971 | United Kingdom | 137/530 |
| 661112 | 5/1979 | U.S.S.R. | 405/302 |

*Primary Examiner*—Dennis L. Taylor

*Attorney, Agent, or Firm*—Thompson, Birch, Gauthier & Samuels

[57] ABSTRACT

A mine roof support unit has a floor sill, a roof cap supported above the floor sill by a pair of inclined hydraulic props, and control apparatus for controlling load-bearing capacity of the props. The inclination of the props relative to the vertical increases as the props are retracted. The control apparatus comprises a pressure-relief valve for limiting the pressure of the hydraulic fluid supplied to the hydraulic props. The pressure-relief valve has a closure member which is biased towards its closed position by a spring. The spring is backed by an abutment member which constitutes a setting device for adjusting the biasing force of the spring, thereby controlling the operating pressure of the pressure-relief valve, and hence the load-bearing capacity of the props. The setting device is operatively associated with a movable part of the roof support unit in such a manner that the operating pressure of the pressure-relief valve is reduced in response to movement of said movable part of the roof support unit which results from extension of the hydraulic props.

28 Claims, 5 Drawing Figures

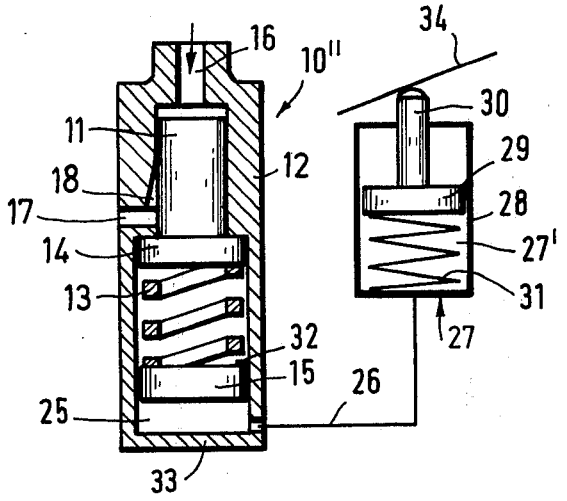
FIG.4
FIG.5
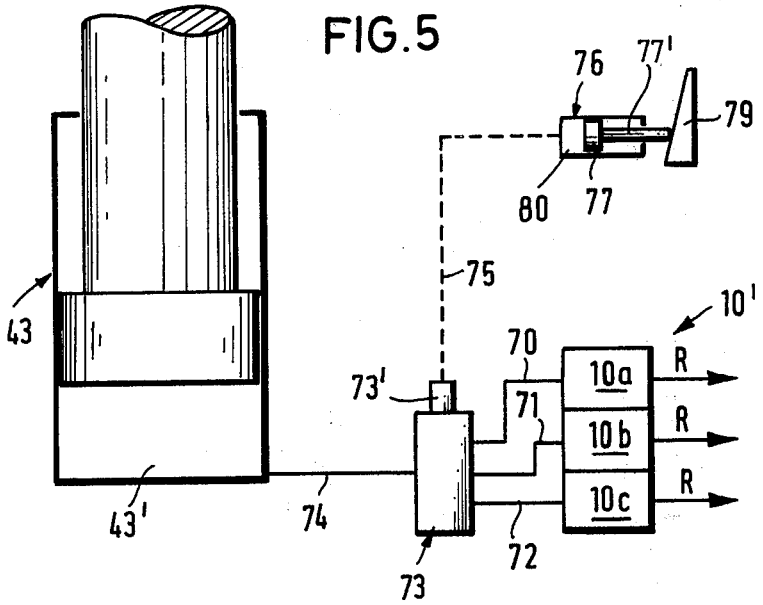

CONTROL APPARATUS

BACKGROUND TO THE INVENTION

This invention relates to apparatus for controlling the load-bearing capacity of the hydraulic props of a mine roof support unit, particularly a mine roof support unit having hydraulic props whose inclination to the vertical increases as the props are extended. Throughout this specification the term "vertical", when used with reference to the inclincation of the hydraulic props of a mine roof support unit, should be taken to mean the direction perpendicular to the floor of the working on which the mine roof support unit stands.

A known type of mine roof support unit for use in a longwall working has a roof cap supported on a floor sill by a pair of hydraulic props. The hydraulic props are articulatedly attached to both the floor sill and the roof cap, and are inclined so that, in use, their upper ends are nearer the longwall face than their lower ends. This type of roof support unit usually has a goaf shield pivotally connected between the goaf-side ends of the roof cap and the floor sill. The goaf shield is preferably connected to the floor sill by a pair of links constituting a lemniscate linkage. As the hydraulic props are extended and retracted, they each pivot in a vertical plane perpendicular to the face. Thus, as the props are extended, they become increasingly inclined relative to the vertical.

Roof support units of this type are designed to be used in longwall workings of differing heights. Obviously, the units are required to support the roof of a longwall working no matter how high its roof is. Consequently, the hydraulic props of roof support units of this type need to have a sufficient load-bearing capacity that the vertical component thereof (that is to say the component available for roof support) is sufficiently large to support the roof, even when the props are fully extended and at their maximum angle of inclination to the vertical. Unfortunately, by having props of sufficient load-bearing capacity to support the roof under maximum inclination conditions, the vertical component of the load-bearing capacity when the props are fully extended (that is to say when their inclination to the vertical is a minimum) is far too high. In particular, the roof cap may be pressed against the roof with sufficient force to damage the roof, and the floor sill may be forced down into the floor of the working. Moreover, the roof support unit has to be of excessively heavy construction to take up the large upward forces which occur at maximum prop extension.

The aim of the invention is to provide apparatus for controlling the load-bearing capacity of the inclined hydraulic props of a mine roof support unit so that the above-mentioned disadvantages are obviated.

SUMMARY OF THE INVENTION

The present invention provides apparatus for controlling the load-bearing capacity of the hydraulic prop means of a mine roof support unit, the mine roof support unit being of the type having a roof-engageable structure supported above a floor-engageable structure by inclined hydraulic prop means, the inclination of the hydraulic prop means relative to the vertical increasing as the hydraulic prop means is retracted, the control apparatus comprising pressure-relief valve means for limiting the pressure of the hydraulic fluid supplied to the hydraulic prop means, and a setting device for adjusting the operating pressure of the pressure-relief valve means thereby controlling the load-bearing capacity of the hydraulic prop means, wherein the setting device is operatively associated with a movable part of the roof support unit in such a manner that the operating pressure of the pressure-relief valve means is reduced in response to movement of said movable part of the roof support unit which results from extension of the hydraulic prop means.

The hydraulic props of a roof support unit incorporating control apparatus of this type can, therefore, have their load-bearing capacity controlled in such a manner that the vertical component thereof is substantially constant. This is because the load-bearing capacity is reduced as the inclination of the props to the vertical is reduced, thus compensating for the increase in the vertical force which would have resulted from the decrease in the angle between the actual direction of the force and the vertical. Moreover, because the roof-supporting force is substantially constant, the roof support unit can be made from relatively light-weight components.

Advantageously, the pressure-relief valve means is constituted by a pressure-relief valve having a valve closure member biased towards a closed position by a spring, the biasing force of the spring being controlled by the setting device thereby to adjust the operating pressure of the pressure-relief valve. Preferably, the setting device forms an abutment member for the spring, the setting device being movable, in response to said movement of said movable part of the roof support unit, so as to vary the biasing force of the spring. Conveniently, the valve closure member is reciprocable within a hollow cylindrical member, the hollow cylindrical member also housing the spring and the setting device, and wherein the setting device is constituted by a piston which is reciprocable within the hollow cylindrical member.

In a preferred embodiment, the piston is provided with an axially-extending piston rod which projects beyond an end face of the hollow cylindrical member, and wherein an actuator is provided for engagement with the free end of the piston rod, the actuator being movable in response to said movement of said movable part of the roof support unit thereby moving the piston and varying the biasing force of the spring. The actuator may be of a wedge-shaped member or an eccentrically-mounted cam. Alternatively, the actuator is a hydrostatic rotary or swivel drive. In this case, the hydrostatic rotary or swivel drive may be controlled by a hydrostatic servo-cylinder which is operable in response to said movement of said movable part of the roof support unit.

In another preferred embodiment, the hollow cylindrical member defines a cylindrical working space on that side of the piston remote from the spring, the cylindrical working space being hydraulically connected to a hydraulic actuator, and wherein the hydraulic actuator is operable in response to said movement of said movable part of the roof support unit to vary the pressure of hydraulic fluid in said cylindrical working space, thereby to vary the biasing force of the spring. Advantageously, the hydraulic actuator is constituted by a hydraulic piston-and-cylinder having a working chamber in hydraulic communication with said cylindrical working space, the piston of the hydraulic actuator being spring biased in a direction tending to increase the volume of the working chamber, and the piston of the hydraulic actuator being provided with an axially-extending piston rod projecting from the opposite side of said piston to the working chamber, the free end of the piston rod projecting beyond an end face of the cylinder of the hydraulic actuator and being engageable with an actuating device, the actuating device being movable in response to said movement of said movable part of the roof support unit, thereby to vary the volume of the working chamber of the hydraulic actuator and hence vary the biasing force of the spring of the pressure-relief valve.

The control apparatus may further comprise a transducer for sensing movement of said movable part of the roof support unit, the transducer emitting control signals dependent upon the amount of movement measured, said control signals being effective to control the operating pressure of the pressure-relief valve. Advantageously, the transducer is such as to sense linear movement of said movable part of the roof support unit, and the transducer is constituted by a sensor which senses the linear movement of said movable part of the roof support unit and emits a predetermined number of control impulses in response to a given amount of linear movement, the control impulses being used to control the pressure-relief valve. In this case, the control apparatus may further comprise a hydraulic metering cylinder which receives control impulses from the sensor, the metering cylinder generating an equivalent number of metering strokes to the number of control impulses received, the output of the metering cylinder being hydraulically connected to the cylindrical working space of the pressure-relief valve.

In yet another preferred embodiment, the pressure-relief valve means is constituted by a plurality of pressure-relief valves which are pre-set to operate at different pressures, the arrangement being such that the pressure-relief valves are operated in turn by the setting device, thereby to control the load-bearing capacity of the hydraulic prop means incrementally. Advantageously, the setting device controls the pressure-relief valves via a hydraulic control valve, and the hydraulic control valve is actuated by a hydraulic servo-cylinder, the servo-cylinder being controlled by the setting device. Preferably, the setting device is a hydraulic piston-and-cylinder unit which is hydraulically connected to the servo-cylinder, extension and retraction of the piston-and-cylinder unit being effected by an actuating device which is movable in response to said movement of said movable part of the roof support unit.

The invention also provides a mine roof support unit comprising a floor-engageable structure, a roof-engageable structure supported above the floor-engageable structure by inclined hydraulic prop means, and control apparatus for controlling the load-bearing capacity of the hydraulic prop means, the inclination of the hydraulic prop means relative to the vertical increasing as the hydraulic prop means is retracted, wherein the control apparatus is as defined above.

In a preferred embodiment, the hydraulic prop means is constituted by two hydraulic props, and the pressure-relief valve means is constituted by a pressure-relief valve, the pressure-relief valve being effective to limit the pressure of hydraulic fluid supplied to each of the hydraulic props. Alternatively, the hydraulic prop means is constituted by two hydraulic props, and the pressure-relief valve means is constituted by two pressure-relief valves, each pressure-relief valve being effective to limit the pressure of the hydraulic fluid supplied to a respective hydraulic prop. In either case, the pressure-relief valve means may be controlled directly by engagement with said movable part of the roof support unit.

Preferably, however, the pressure-relief valve means is controlled by an actuating member attached to said movable part of the roof support unit.

When the pressure-relief valve is hydraulically actuated, the transducer may be such as to sense angular movement of said movable part of the roof support unit, and the transducer may be arranged within, or adjacent to, the pivotal axis of a pivot joint associated with said movable part of the roof support unit. In this case, the transducer may be a strain gauge attached to a flexible element which is arranged between said movable part of the roof support unit and a further part of the roof support unit which is pivotally connected to said movable part by said pivot joint.

Preferably, the pressure-relief valve means is accommodated in a hollow component of the roof support unit, said hollow component being positioned adjacent to said movable part of the roof support unit.

BRIEF DESCRIPTION OF THE DRAWINGS

A mine roof support unit incorporating control apparatus constructed in accordance with the invention will now be described, by way of example, with reference to the accompanying drawings, in which:

FIGS. 2 to 5 show four different forms of control apparatus for use with the mine roof support unit of FIG. 1.

DESCRIPTION OF PREFERRED EMBODIMENTS

Figure 1:
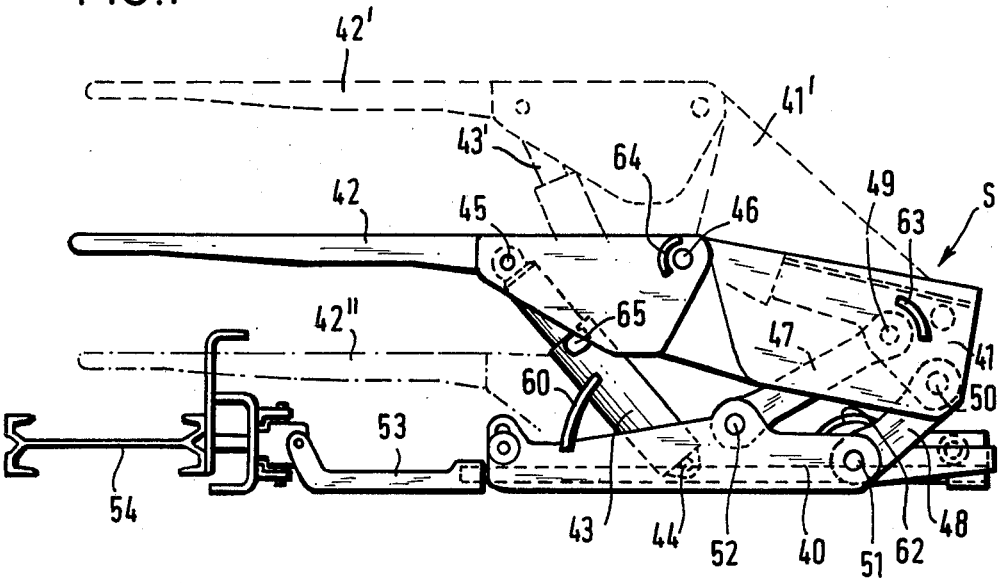
FIG. 1 is a side elevation of the mine roof support unit.
Figure 2:
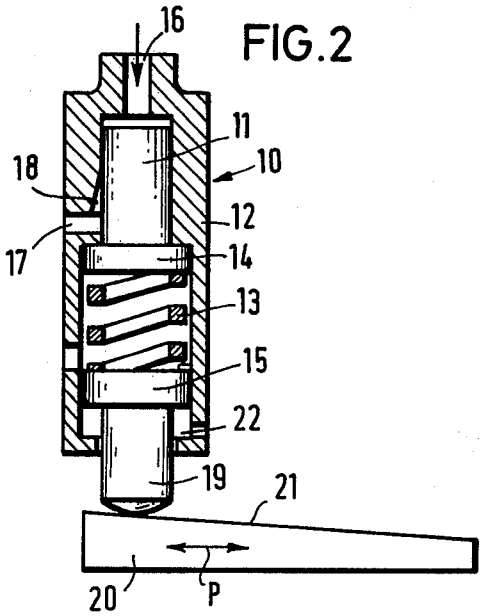

Referring to the drawings, FIG. 2 shows a first form of control apparatus for controlling the load-bearing capacity of the hydraulic prop (or props) of a mine roof support unit 5 (see FIG. 1). The control apparatus comprises a pressure-relief valve 10 and an actuator 20. The pressure-relief valve 10 has a valve closure member 11 constituted by a spool. The spool 11 is reciprocable within the cylindrical housing 12 of the valve 10. The spool 11 is biased towards its closed position by a spring 13. The spring 13 acts against a disc-shaped end plate 14 formed integrally with the spool 11, a piston 15 constituting an abutment for the spring. The valve housing 12 is provided with an inlet port 16 and an outlet port 17. The inlet port 16 is connected to the working chamber(s) of the associated hydraulic prop(s), and the outlet port 17 is connected to a return line (not shown). The position of the piston 15 determines the degress of compression of the spring 13, and hence the setting of the valve 10 (that is to say the pressure at which the valve opens). In order to open the valve 10, the hydraulic pressure applied to the inlet port 16 must be sufficient to move the spool 11, against the biasing force of the spring 13, until the ports 15 and 17 are in fluid communication via one or more throttle notches 18.

The position of the piston 15, (and hence the biasing force of the spring 13) is adjustable by means of a wedge-shaped actuator 20 which engages a piston rod 19, the piston rod 19 being formed integrally with the piston, and extending axially beyond the end face of the housing 12. Alternatively, the piston rod 19 is fixed to the piston 15. The actuator 20 has a tapered wedge face 21 against which the free end of the piston rod 19 abuts under the biasing force of the spring 13. The actuator 20 is reciprocable in the directions of the double arrow P, this actuator movement causing the piston 15 to reciprocate within the housing 12. FIG. 2 shows the actuator 20 in the position in which the piston 15 has been moved into the housing 12 to the maximum extent. In this position, the spring 13 is compressed to its greatest extent, so that the spring exerts its maximum biasing force. If the actuator 20 is moved to the left (as seen in FIG. 2), the biasing force of the spring 13 is reduced, and the piston 15 moves down within the housing 12. Continued movement of the actuator 20 to the left causes the piston 15 to move down until it bears against a stop constituted by the annular end face 22 of the housing 12. With the actuator 20 in this position, the spring 13 exerts its minimum biasing force.

Figure 3:
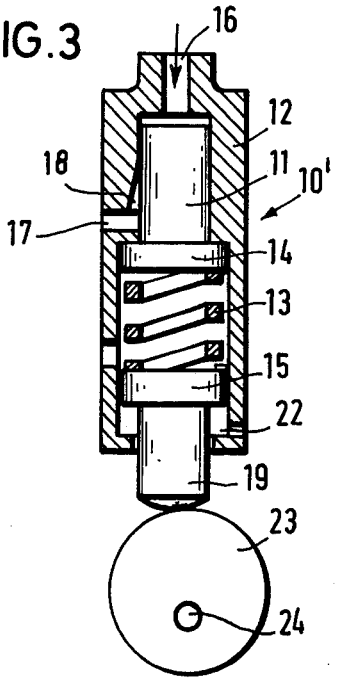

FIG. 3 shows a second form of control apparatus. This form of control apparatus comprises a pressure-relief valve 10′ (which is identical to the pressure-relief valve 10 of FIG. 2) and an actuator 23. The actuator 23 is a disc which is rotatably mounted on an eccentric shaft 24. The piston rod 19 of the pressure-relief valve 10′ abuts against the edge of the disc 23. Thus, rotation of the disc 23 causes the piston 15 to reciprocate within the valve housing 12. As with the embodiment of FIG. 2, the biasing force of the spring 13 (and hence the pressure at which the valve 10′ opens) is continuously variable between minimum and maximum values.

FIG. 4 shows a third form of control apparatus, this apparatus having a pressure-relief valve 10″ and a hydraulic actuator 27. The pressure-relief valve 10″ is basically the same as the valve 10 and 10′, except that its piston 15 has no piston rod, the bore 33 of the valve housing 12 is closed, and the cylinder space 25 beneath the piston is connected to the hydraulic actuator 27 by a hydraulic line 26. The hydraulic actuator 27 has a cylinder 28, a piston 29 reciprocable within the cylinder 28, and a piston rod 30 attached to (or integrally formed with) the piston 29, the piston rod extending axially beyond the end face of the cylinder 28. The actuator 27 has a working chamber 27′ connected to the hydraulic line 26, and a spring 31 biasing the piston 29 in the direction in which the free end of the piston rod is forced out of the cylinder 28. The piston 29 is movable down (as seen in FIG. 4), against the bias of the spring 31, by means of an actuating member 34 (which is shown only diagrammatically). During this movement, hydraulic fluid is forced out of the chamber 27′, through the line 26, and into the cylinder space 25 of the pressure-relief valve 10″. This causes the piston 15 to move upwardly (as seen in FIG. 4), thereby increasing the biasing force of the spring 13. FIG. 4 shows the piston 15 in its uppermost position, this position being defined by a stop 32 attached to the valve housing 12. The biasing force of the spring 13 is maximum when the piston 15 is in this position. When the piston 29 moves in the opposite direction (that is to say upwardly as seen in FIG. 4), hydraulic fluid flows from the cylinder space 25 of the valve 10″ into the chamber 27′ of the actuator 27. The consequent reduction in hydraulic pressure in the cylinder space 25 results in the piston 25 moving downwards under the bias of the spring 13. Thus, the hydraulic actuator 27 is effective to vary the biasing force of the spring 13 (and hence the pressure at which the valve 10″ opens) in a continuous manner between minimum and maximum values. The actuating member 34, which is used to move the piston 29 down against the force of the spring 31, is a wedge-shaped member similar to the actuator 20 of FIG. 2.

In each of the forms of control apparatus described above with reference to FIGS. 2 to 4, the adjustment of the position of the piston 15 (and hence the biasing force of the spring 13) is controlled, either directly or indirectly, by the movement of part of a mine roof support unit. The movement of said mine roof support unit part may be linear or arcuate. FIG. 1 shows the construction of one well known type of mine roof support unit S, this figure also showing schematically alternative positions for the different types of control apparatus shown in FIGS. 2 to 4. Thus, FIG. 1 shows a mine roof support unit S having a floor sill 40, a goaf shield 41, a roof cap 42, and a pair of hydraulic props 43 (only one of which can be seen) which support the roof cap. The floor sill 40 may be of one-part or multi-part construction. Each of the props 43 is supported on the floor sill 40 by a universal joint 44, and each supports the roof cap 42 by means of a universal joint 45. The goaf shield 41 is pivotally connected to the rear end of the roof cap 42 by means of a pivot joint 46. The lower region of the goaf shielf 41 is connected to the floor sill 40 by means of a lemniscate linkage constituted by a pair of links 47 and 48. The links 47 and 48 are pivotally attached to the goaf shield 41 by respective pivot joints 49 and 50, and are pivotally attached to the floor sill 40 by respective pivot joints 51 and 52.

The roof support unit S is connected, in known manner, to a longwall conveyor 54 (such as a scraper-chain conveyor), by means of an advance mechanism 53. The conveyor 54 is positioned in front of a longwall face (not shown).

FIG. 1 shows (in full lines) the roof support unit S with the props 43 extended by about one-half of their maximum extended length. The props 43 are inclined to the vertical, and slope upwards towards the face. FIG. 1 also shows (in dashed lines) the position of the roof support unit S when the props 43 are fully extended, and (in dot-dash lines) the position of the roof support unit when the props are fully retracted. In the former case, the goaf shield is indicated by the reference numeral 41′, the roof cap by the reference numeral 42′, and the props by the reference numeral 43′; and, in the latter case, the roof cap is indicated by the reference numeral 42″. It can be seen that the props 43 incline more to the vertical as they are extended. In particular, when they are fully extended, the props 43′ are inclined at a relatively small angle to the vertical; whereas, when they are fully retracted, the props are inclined at a relatively large angle to the vertical. As the props 43 are extended or retracted, the links 47 and 48 execute swivelling movements relative to the floor sill 40 and the goaf shield 41. At the same time, the goaf shield 41 pivots relative to the roof cap 42.

When the props 43 are fully retracted, their inclination to the vertical is a maximum, and hence the vertical component of their load-bearing capacity (that is to say the force available for roof support) is a minimum. The load-bearing capacity of the props 43 is the maximum load which they can support. Obviously, the load-bearing capacity of the props 43 is chosen to be sufficiently large to support the roof when the props are at their maximum inclination to the vertical. However, as the inclination of the props 43 to the vertical decreases, the vertical component of the load-bearing capacity increases, so that the available roof-supporting force increases. In order to prevent the roof-supporting force becoming excessively large as the props 43 are extended, a pressure-relief valve 10 (or 10' or 10'') is associated with the props. The valve 10 is positioned on the roof support unit S in such a manner that a movable part of the unit is used to actuate the valve so that the valve opens at lower pressures as the props are extended. Thus, the entire roof support unit S can be of lighter construction than known units, so that a cheaper product results. Alternatively, a pressure-relief valve 10 (or 10' or 10'') is associated with each of the props 43.

The pressure-relief valve 10 may be positioned so as to be actuated directly by a movable part of the roof support unit S, that is to say the piston rod 19 of the embodiments of FIGS. 2 and 3 could be actuated directly by said movable part. Alternatively, the piston 15 of each type of control apparatus could be actuated indirectly by a movable part of the roof support unit S, that is to say the actuators 20 and 23 of FIGS. 2 and 3 or the actuating member 34 of FIG. 4, could be attached to (or form part of) said movable part.

FIG. 1 shows diagrammatically an actuating device 60 secured to one of the props 43. The actuating device 60 could be either of the actuators 20 and 23, the actuating member 34, or any other suitable form of actuating member such as a cam, a lever, a hydrostatic rotary or swivel drive, a transducer (either a transducer responsive to linear or angular movement), or a strain gauge. For example, the actuating device 60 could be the wedge-shaped actuator 20 of FIG. 2. In this case, the arrangement is such that, when the props 43 are fully retracted, the actuating device 60 holds the piston 15 of the associated valve 10 in the position in which the biasing force of the spring 13 is maximum. As the props 43 are extended, the inclined face of the wedge-shaped actuating device 60 slides along the free end of the piston rod 19 of the valve 10, so that the piston 15 moves gradually to reduce the biasing force of the spring 13.

Similarly, the actuating device 60 could be shaped so as to constitute the curved peripheral surface of the eccentrically-mounted actuator 23 of the FIG. 3 control apparatus; or the actuating device could be the actuating member 34 of the FIG. 4 control apparatus.

Instead of positioning the actuating device 60 on one of the props 43, use can be made of similar devices associated with other movable parts of the roof support unit S. For example, FIG. 1 shows diagrammatically an actuating device 62 which is secured to the goaf side link 48. Obviously, the actuating device 62 could be secured to the other link 47 instead. It is also possible to arrange an actuating device 63 on one of the pivot joints of the roof support unit S. For example, FIG. 1 shows an actuating device 63 associated with the pivot joint 49. The actuating device 63 is so positioned that, as the link 47 swivels in response to extension or retraction of the props 43, the piston 15 of the associated pressure-relief valve 10, 10' or 10'' is adjusted. Obviously, an actuating device of this type could be associated with any other pivot joint (such as the pivot joints 44, 45, 46, 50, 51 and 52) of the roof support unit S. FIG. 1 shows one such actuating device 64, which is associated with the pivot joint 46.

Like the actuating device 60, each of the actuating devices 62, 63 and 64 could be either of the actuators 20 and 23, the actuating member 34, or any other suitable form of actuating member such as a cam, a lever, a hydrostatic rotary or swivel drive, a transducer (either a transducer responsive to linear or angular movement), or a strain gauge.

Where the control apparatus of FIG. 4 is used, the valve 10'' can be positioned with the other hydraulic valves of the roof support unit S, no matter where the actuating device such as 60, 62, 63 or 64 is positioned. Typically, the valve 10'' will form part of a control valve block.

FIG. 5 shows a fourth form of control apparatus for use with the roof support unit S, this apparatus having three pressure-relief valves **10*a*, 10*b* and 10*c*. The pressure-relief valves 10*a*, 10*b* and 10*c* are of known conventional construction, and each is pre-set to respond at a different operating pressure, the valve 10*a* being set to respond at the highest pressure, the valve 10*b* being set to respond at an intermediate pressure, and the valve 10*c* being set to respond at a low pressure. The valves 10*a*, 10*b* and 10*c* are connected, via respective hydraulic lines 70, 71 and 72, to a common control valve 73. The control valve 73 is connected, by a hydraulic line 74, to the working chamber 43' of a prop 43 of the roof support unit S. Alternatively, the line 74 is connected to the working chambers 43' of both the props 43 of the roof support unit S. The control valve 73 is a servo-operated valve, having a servo-cylinder 73' which is connected, via a hydraulic control line 75, to the working chamber 81 of a hydraulic actuator 76. The actuator 76 is a cylinder which houses a reciprocable piston 77. The piston 77 has a piston rod 77', the free end of which abuts a wedge-shaped actuating device 79. Reciprocal movement of the actuating device 79 thus results in reciprocal movement of the piston 77 within the cylinder 76. The actuating device 79 is associated with a movable part of the roof support unit S in such a manner that its movement is dependent upon the retraction and extension of the associated prop 43. During retraction of the piston 77 (that is to say during inward movement of the piston), hydraulic fluid is forced out of the working chamber 80, along the line 75 and into the servo-cylinder 73'. This causes the position of the control valve 73 to be reversed. The arrangement is such that, when the prop 43 is extended from its fully-retracted position, the working chamber 43' of the prop is connected, via the line 74, the control valve 73 and the line 70, to the pressure relief valve 10*a*. Thus, the load-bearing capacity of the prop 43 is reduced, in a first step, to a first (high) value. Further extension of the prop 43 causes the piston 77 to retract further, and this results in the working chamber 43' being connected to the valve 10*b* via the line 74, the control valve 73 and the line 71. Thus, the load-bearing capacity of the prop 43 is reduced, in a second step, to a second (intermediate) value. When the prop 43 is further extended (to its fully-extended position), the piston 77 is further retracted, and the working chamber 43' is connected to the valve 10*c* via the line 74, the control valve 73 and the line 72. Thus, the load-bearing capacity of the prop 43 is reduced, in a third step, to a third (low) value. Consequently, the arrangement of FIG. 5 is effective to reduce the load-bearing capacity of the prop(s) 43 in a stepwise manner as the prop(s) is (or are) extended. Obviously, by providing more pressure-relief valves having different operating pressures, the load-bearing capacity of the prop(s) 43** can be controlled in a greater number of steps.

As with the embodiments of FIGS. 2 to 4, the actuating device 79 of the FIG. 5 control apparatus can be attached to any movable part of the roof support unit S.

Alternatively, the piston rod 77' of the cylinder 76 could be controlled directly by any such movable part. The actuating device could also be an eccentric actuator (such as the actuator 23 of FIG. 3), or any other suitable form of actuating member such as a cam, a lever, a hydrostatic rotary or swivel drive, a transducer (either a transducer responsive to linear or angular movement), or a strain gauge. In particular, such actuating members can be positioned at any of the positions 60, 62, 63 or 64, or at any of the pivot joints 44, 45, 50, 51 and 52. Moreover, the hydraulic actuator 76 could be replaced by another type of actuator such as a mechanical drive or an electro-magnetic device. It is also possible to operate the control valve 73 directly, either by an actuating member 79 attached to a movable part of the unit S, or directly by such a movable part.

As indicated above, each form of control apparatus can be actuated in a large variety of ways. It is also possible, in each case, to sense movement of part of the roof support unit S using a sensor. The sensor can then be used to control the associated pressure-relief valve. The parameter for such a control process may be, for example, the angular position of the prop or props 43, the angular position of the link 47, the link 48 or the goaf shield 41, or the distance between two points on the links 47 and 48.

Where the actuating member of any of the different forms of control apparatus is a hydrostatic rotary or swivel drive, such a drive may be controlled in dependence upon the angular path travelled by a movable roof support unit part. Alternatively, some other parameter may be used to control such a rotary or swivel drive. In order to produce a control signal dependent upon the variation of the particular parameter, a hydrostatic servo-cylinder may be provided, the length of the working stroke of such a servo-cylinder being dependent upon the parameter (for example, the angular displacement of a movable roof support unit part). In this case, the pressurized hydraulic fluid discharged by the servo-cylinder is passed to a rotary or swivel drive for altering the bias of the spring 13.

Another way of controlling the spring bias of the pressure-relief valve 10" is to use an incremental switch or a counting unit. Such a switch or counting unit would be arranged to emit a predetermined number of switching impulses in response to a given amount of movement of a movable roof support unit part. These switching impulses could be generated either mechanically or electrically, and each impulse would operate a small hydraulic metering cylinder. Thus, the predetermined number of impulses would generate an equivalent number of metering strokes of the metering cylinder, and the volume of hydraulic fluid delivered during these metering strokes would be directed to the cylinder space 25 of the control valve 10". The bias of the spring 13 could, therefore, be controlled accurately and positively.

In order to transmit control movements to the valve 10 and a rack-and-pinion drive may be used. The linear movement of such a drive could be converted, for example, by means of a cam or eccentric, into a rotary movement, so that a rack-and-pinion drive could also be used with the control apparatus of FIG. 3.

It is possible to position the pressure-relief valve 10 (or 10' or 10") at or near the axis of rotation of one of the pivot joints of the roof support unit S. In this case, the arrangement may be such that the angular displacement of the associated movable roof support unit part is transmitted directly or indirectly, for example via a measured-valve converter (or transducer), to the respective pressure-relief valve in order to vary its spring bias. The transducer may be a strain gauge carried by a flexible element arranged between two relatively-movable parts of the roof support unit S. The output of the strain gauge can then be used for controlling the spring bias of an associated pressure-relief valve.

In each case, the pressure-relief valve 10, 10' or 10" may be housed in a hollow component of the roof support unit S, preferably one positioned adjacent to the associated movable part of the unit.

We claim:

1. In a mine roof support unit comprising a floor-engageable structure, and a roof engageable structure supported above the floor-engageable structure by inclined hydraulic prop means, the inclination of the hydraulic prop means relative to the vertical increasing as the hydraulic prop means is retracted, the improvement comprising providing control apparatus for controlling the load-bearing capacity of the hydraulic prop means, the control apparatus comprising pressure-relief valve means for limiting the pressure of the hydraulic fluid supplied to the hydraulic prop means, and a setting device for adjusting the operating pressure of the pressure-relief valve means thereby controlling the load-bearing capacity of the hydraulic prop means, wherein the setting device is operatively associated with a movable part of the roof support unit in such a manner that the operating pressure of the pressure-relief valve means is reduced in response to movement of said movable part of the roof support unit which results from extension of the hydraulic prop means.

2. Control apparatus according to claim 1, wherein the pressure-relief valve means comprises a pressure-relief valve having a valve closure member biased towards a closed position by a spring, the biasing force of the spring being controlled by the setting device thereby to adjust the operating pressure of the pressure-relief valve.

3. Control apparatus according to claim 2, wherein the setting device forms an abutment member for the spring, the setting device being movable, in response to said movement of said movable part of the roof support unit, so as to vary the biasing force of the spring.

4. Control apparatus according to claim 3, wherein the valve closure member is reciprocable within a hollow cylindrical member, the hollow cylindrical member also housing the spring and the setting device, and wherein the setting device is constituted by a piston which is reciprocable within the hollow cylindrical member.

5. Control apparatus according to claim 4, wherein the piston is provided with an axially-extending piston rod which projects beyond an end face of the hollow cylindrical member, and wherein an actuator is provided for engagement with the free end of the piston rod, the actuator being movable in response to said movement of said movable part of the roof support unit thereby moving the piston and varying the biasing force of the spring.

6. Control apparatus according to claim 5, wherein the actuator is a wedge-shaped member.

7. Control apparatus according to claim 5, wherein the actuator is an eccentrically mounted cam.

8. Control apparatus according to claim 5, wherein the actuator is a hydrostatic rotary or swivel drive.

9. Control apparatus according to claim 8, wherein the hydrostatic rotary or swivel drive is controlled by a hydrostatic servo-cylinder which is operable in response to said movement of said movable part of the roof support unit.

10. Control apparatus according to claim 4, wherein the hollow cylindrical member defines a cylindrical working space on that side of the piston remote from the spring, the cylindrical working space being hydraulically connected to a hydraulic actuator, and wherein the hydraulic actuator is operable in response to said movement of said movable part of the roof support unit to vary the pressure of hydraulic fluid in said cylindrical working space, thereby to vary the biasing force of the spring.

11. Control apparatus according to claim 10, wherein the hydraulic actuator comprises a hydraulic piston-and-cylinder having a working chamber in hydraulic communication with said cylindrical working space, the piston of the hydraulic actuator being spring biased in a direction tending to increase the volume of the working chamber, and the piston of the hydraulic actuator being provided with an axially-extending piston rod projecting from the opposite side of said piston to the working chamber, the free end of the piston rod projecting beyond an end face of the cylinder of the hydraulic actuator and being engageable with an actuating device, the actuating device being movable in response to said movement of said movable part of the roof support unit, thereby to vary the volume of the working chamber of the hydraulic actuator and hence vary the biasing force of the spring of the pressure-relief valve.

12. Control apparatus according to claim 10, further comprising a transducer for sensing movement of said movable part of the roof support unit, the transducer emitting control signals dependent upon the amount of movement measured, said control signals being effective to control the operating pressure of the pressure-relief valve.

13. Control apparatus according to claim 12, wherein the transducer is such as to sense linear movement of said movable part of the roof support unit.

14. Control apparatus according to claim 13, wherein the transducer comprises a sensor which senses the linear movement of said movable part of the roof support unit and emits a predetermined number of control impulses in response to a given amount of linear movement, the control impulses being used to control the pressure-relief valve.

15. Control apparatus according to claim 14, further comprising a hydraulic metering cylinder which receives control impulses from the sensor, the metering cylinder generating an equivalent number of metering strokes to the number of control impulses received, the output of the metering cylinder being hydraulically connected to the cylindrical working space of the pressure-relief valve.

16. Control apparatus according to claim 1, wherein the pressure-relief valve means comprises a plurality of pressure-relief valves which are pre-set to operate at different pressures, the arrangement being such that the pressure-relief valves are operated in turn by the setting device, thereby to control the load-bearing capacity of the hydraulic prop means incrementally.

17. Control apparatus according to claim 16, wherein the setting device controls the pressure-relief valves via a hydraulic control valve.

18. Control apparatus according to claim 16, wherein the hydraulic control valve is actuated by a hydraulic servo-cylinder, the servo-cylinder being controlled by the setting device.

19. Control apparatus according to claim 18, wherein the setting device is a hydraulic piston-and-cylinder unit which is hydraulically connected to the servo-cylinder, extension and retraction of the piston-and-cylinder unit being effected by an actuating device which is movable in response to said movement of said movable part of the roof support unit.

20. Control apparatus according to claim 12, wherein the transducer is such as to sense angular movement of said movable part of the roof support unit, and the transducer is arranged within, or adjacent to, the pivotal axis of a pivot joint associated with said movable part of the roof support unit.

21. Control apparatus according to claim 20, wherein the transducer is a strain gauge attached to a flexible element which is arranged between said movable part of the roof support unit and a further part of the roof support unit which is pivotally connected to said movable part by said pivot joint.

22. A mine roof support unit comprising a floor-engageable structure, a roof-engageable structure supported above the floor-engageable structure by inclined hydraulic prop means, and control apparatus for controlling the load-bearing capacity of the hydraulic prop means, the inclination of the hydraulic prop means relative to the vertical increasing as the hydraulic prop means is retracted, the control apparatus comprising pressure-relief valve means for limiting the pressure of the hydraulic fluid supplied to the hydraulic prop means, and a setting device for adjusting the operating pressure of the pressure-relief valve means thereby controlling the load-bearing capacity of the hydraulic prop means, wherein the setting device is operatively associated with a movable part of the roof support unit in such a manner that the operating pressure of the pressure-relief valve means is reduced in response to movement of said movable part of the roof support unit which results from extension of the hydraulic prop means.

23. A roof support unit according to claim 22, wherein the hydraulic prop means comprises two hydraulic props, and the pressure-relief valve means comprises a pressure-relief valve, the pressure-relief valve being effective to limit the pressure of hydraulic fluid supplied to each of the hydraulic props.

24. A roof support unit according to claim 22, wherein the hydraulic prop means comprises two hydraulic props, and the pressure-relief valve means comprises two pressure-relief valves, each pressure-relief valve being effective to limit the pressure of the hydraulic fluid supplied to a respective hydraulic prop.

25. A roof support unit according to claim 22, wherein the pressure-relief valve means is controlled directly by engagement with said movable part of the roof support unit.

26. A roof support unit according to claim 22, wherein the pressure-relief valve means is controlled by an actuating member attached to said movable part of the roof support unit.

27. A roof support unit according to claim 22, wherein the pressure-relief valve means is accommodated in a hollow component of the roof support unit.

28. A roof support unit according to claim 27, wherein said hollow component is positioned adjacent to said movable part of the roof support unit.

* * * * *